US010293630B2

(12) United States Patent
Shawki

(10) Patent No.: US 10,293,630 B2
(45) Date of Patent: May 21, 2019

(54) SPINNING WRITING INSTRUMENTS

(71) Applicant: Alpha Engineering Works LLC, Gardena, CA (US)

(72) Inventor: Aimen Shawki, Gardena, CA (US)

( * ) Notice: Subject to any disclaimer, the term of this patent is extended or adjusted under 35 U.S.C. 154(b) by 90 days.

(21) Appl. No.: 15/724,341

(22) Filed: Oct. 4, 2017

(65) Prior Publication Data

US 2019/0100052 A1 Apr. 4, 2019

(51) Int. Cl.

| | |
|---|---|
| ***B43K 7/12*** | (2006.01) |
| ***B43K 5/00*** | (2006.01) |
| ***B43K 21/00*** | (2006.01) |

(52) U.S. Cl.

CPC ..... *B43K 5/005* (2013.01); *B43K 21/006* (2013.01)

(58) Field of Classification Search

CPC ..... B43K 5/005; B43K 5/16
USPC ..... 401/109
See application file for complete search history.

(56) References Cited

U.S. PATENT DOCUMENTS

| | | | | |
|---|---|---|---|---|
| 1,701,771 A * | 2/1929 | Di Stefano | F25C 5/043 30/162 |
| 2,530,901 A * | 11/1950 | Nichols | B43K 24/12 401/112 |
| 5,048,989 A * | 9/1991 | Stageman | B43K 21/18 401/109 |
| 6,264,388 B1 * | 7/2001 | Wang | B43K 24/06 401/109 |
| 2009/0097906 A1 * | 4/2009 | Jacobs | B43K 5/005 401/202 |

* cited by examiner

*Primary Examiner* — Huyen D Le
(74) *Attorney, Agent, or Firm* — Carlos R. Perez-Toro

(57) ABSTRACT

Disclosed herein embodiments for a writing instrument operable to spin around its lateral axis while held on opposite sites. An embodiment includes a barrel, a first bearing coupled to an interior side of the barrel and a second bearing coupled to an interior opposite side of the barrel. A first stub protrudes from a side of the barrel, the stub being in contact with the bearing so as to allow the stub to spin around a lateral axis of the barrel, the lateral axis comprising an axis perpendicular to a length of the barrel. A second stub protrudes from an opposite side of the barrel, the second stub being in contact with the second bearing so as to allow the second stub to spin around the lateral axis of the barrel.

20 Claims, 3 Drawing Sheets

SPINNING WRITING INSTRUMENTS

BACKGROUND

Technical Field

Embodiments generally relate to the design of writing instruments.

Background

Fidgeting is the human habit of moving about restlessly, commonly as a result of nervousness, agitation, or boredom. Examples of fidgeting include playing with one's hair, clothing, a pen, or bouncing one's leg repeatedly. Numerous devices exist that can be described as devices for fidgeting: yo-yos, stress balls, fidget cubes, fidget spinners, etc. These devices may be used to perform a repetitive activity that users may find soothing and relaxing. While fidgeting devices remain popular, most of them may be too conspicuous or unacceptable for use in some social or professional environments.

SUMMARY

Disclosed herein are embodiments for a writing instrument operable to spin around its lateral axis while held on opposite sites. An embodiment includes a barrel, a first bearing coupled to an interior side of the barrel and a second bearing coupled to an interior opposite side of the barrel. A first stub protrudes from a side of the barrel, the stub being in contact with the bearing so as to allow the stub to spin around a lateral axis of the barrel, the lateral axis comprising an axis perpendicular to a length of the barrel. A second stub protrudes from an opposite side of the barrel, the second stub being in contact with the second bearing so as to allow the second stub to spin around the lateral axis of the barrel.

The embodiments disclosed above are only examples, and the scope of this disclosure is not limited to them. Particular embodiments may include all, some, or none of the components, elements, features, functions, operations, or steps of the embodiments disclosed above. Embodiments according to the invention are in particular disclosed in the attached claims. The dependencies or references back in the attached claims are chosen for formal reasons only. However, any subject matter resulting from a deliberate reference back to any previous claims (in particular multiple dependencies) can be claimed as well, so that any combination of claims and the features thereof are disclosed and can be claimed regardless of the dependencies chosen in the attached claims. The subject-matter which can be claimed comprises not only the combinations of features as set out in the attached claims but also any other combination of features in the claims, wherein each feature mentioned in the claims can be combined with any other feature or combination of other features in the claims. Furthermore, any of the embodiments and features described or depicted herein can be claimed in a separate claim and/or in any combination with any embodiment or feature described or depicted herein or with any of the features of the attached claims.

BRIEF DESCRIPTION OF THE DRAWINGS

The accompanying drawings are incorporated herein and form a part of the specification.

In the drawings, like reference numbers generally indicate identical or similar elements. Additionally, generally, the left-most digit(s) of a reference number identifies the drawing in which the reference number first appears.

DETAILED DESCRIPTION

Figure 1:
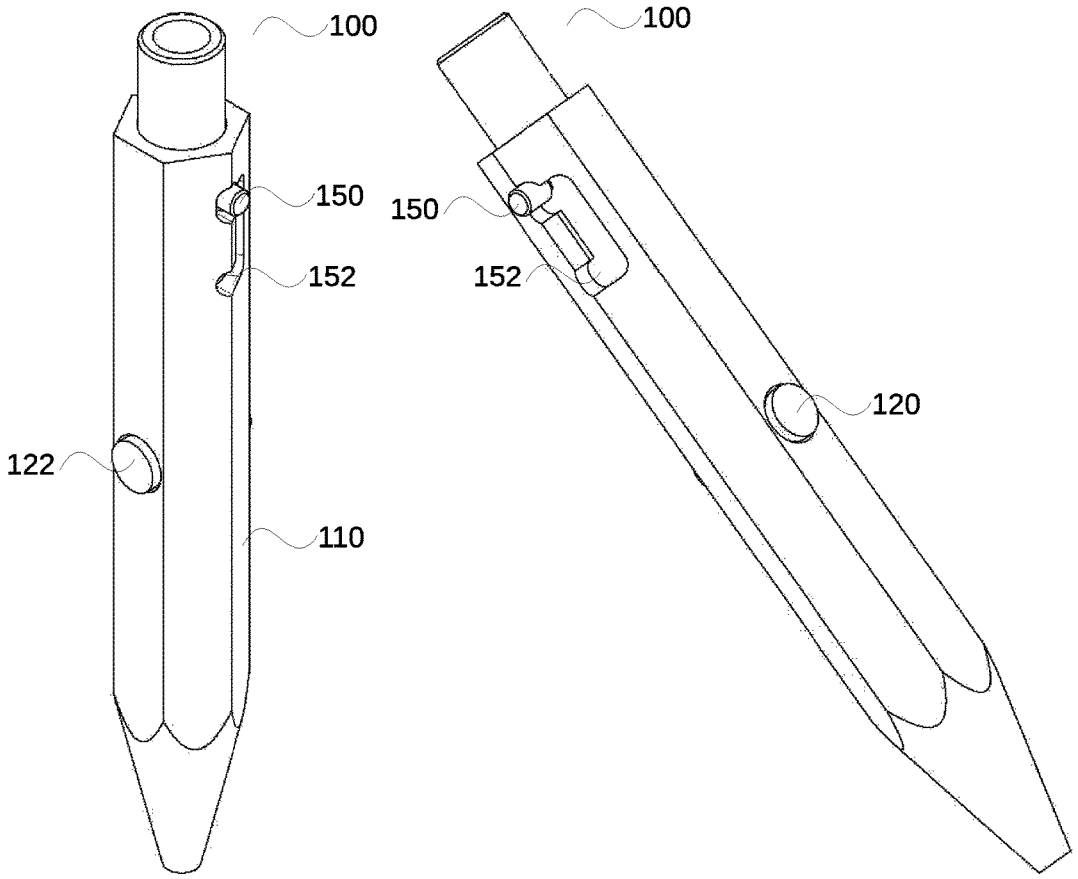
FIG. 1 illustrates two perspective views of a writing instrument, according to particular embodiments.

In particular embodiments, a writing instrument may be operable to around its lateral axis while held on opposite sites. FIG. 1 illustrates two perspective views of a writing instrument 100, according to particular embodiments. Writing instrument 100 may be any instrument operable to be handheld and used to interact with a surface such as, by way of example, a pen, pencil, mechanical pencil, stylus, highlighter, brush, etc.

Figure 3:
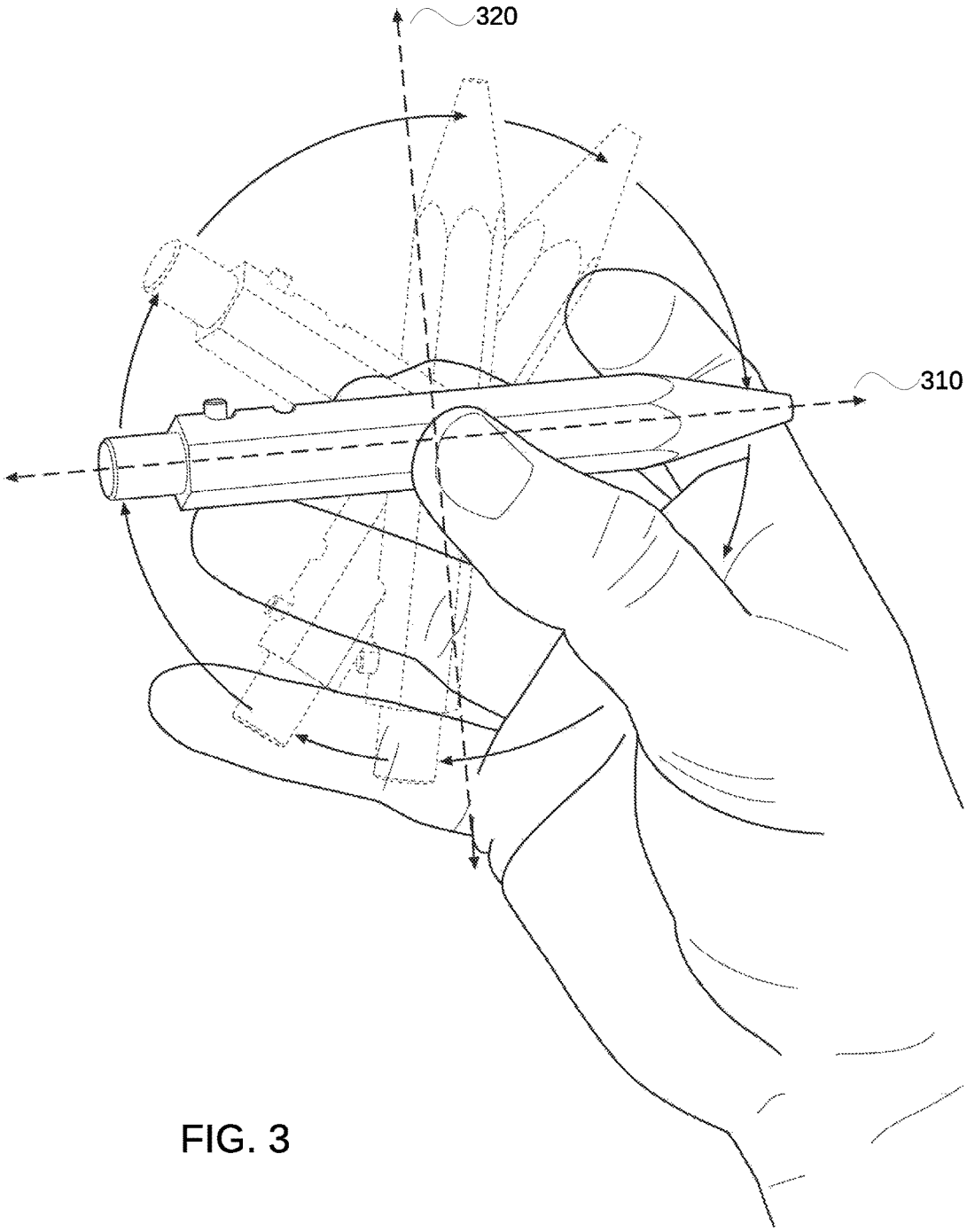
FIG. 3 illustrates the writing instrument being spun around its lateral axis while being held on opposite sides.

Writing instrument 100 may be comprised of a barrel 110 and two stubs (120, 122) protruding from opposite sides of the barrel. Barrel 110 may be a generally cylindrically-shaped member of any material suitable for writing instruments such as, by way of example, plastic, wood, metal, etc. The writing instrument is operable to spin, when held at the stubs, around a lateral axis 320 perpendicular to the longitudinal axis 310 of the barrel 110, as illustrated in FIG. 3. While stubs 120 and 122 are shown having a cylindrical shape, it should be understood and stubs 120 and 122 may have any suitable shape such as, for example, rounded top, square top, a carving of an image, etc.

Figure 2:
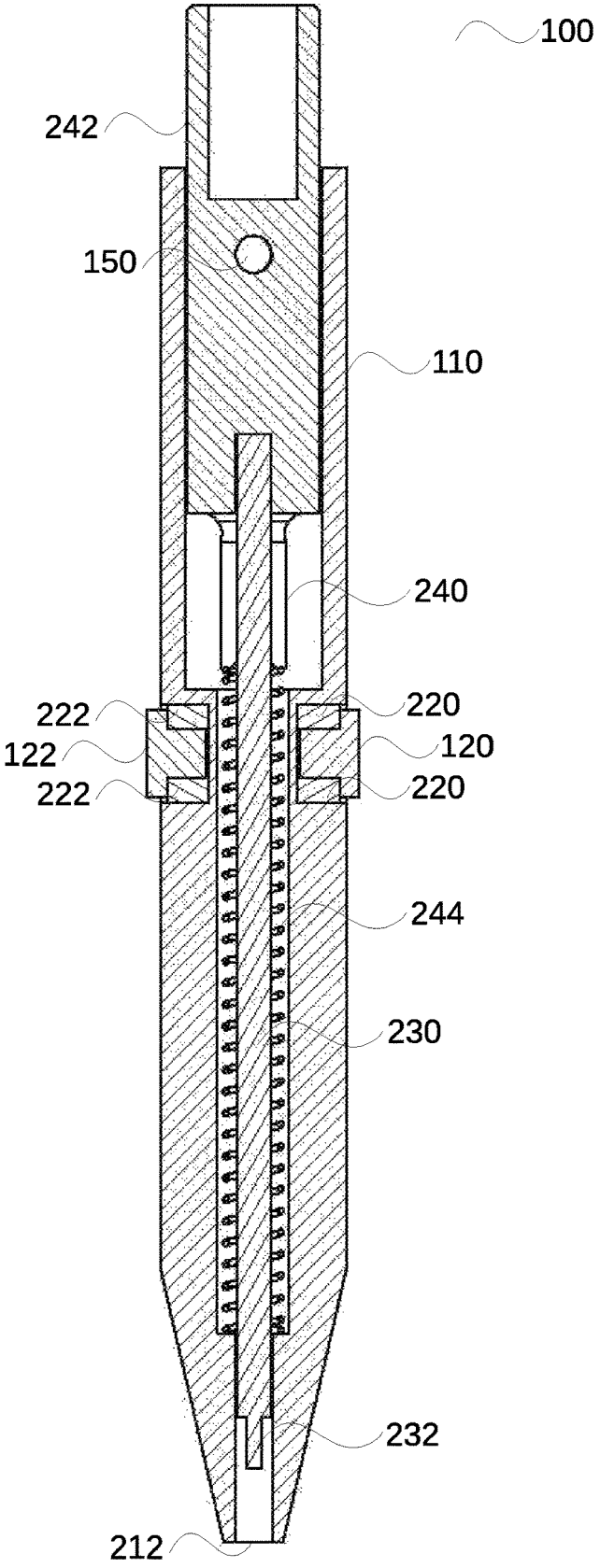
FIG. 2 shows a cross-section view illustrating an inner portion of the writing instrument, according to particular embodiments.

FIG. 2 shows a cross-section view illustrating an inner portion of writing instrument 100, according to particular embodiments. Housed within barrel 110 may be a bearing 220 on one side of barrel 110 and a second bearing 222 on an opposite side of barrel 110. Bearings 220 and 222 are coupled to the inner sides of stubs 120 and 122, respectively. Bearings 220 and 222 may be any bearings suitable for allowing spinning motion of the stubs with respect to barrel 110. For example, bearings 220 and 222 may be ball bearings, roller bearings, plain bearings, magnetic bearings, etc. In particular embodiments, bearings 220 and 222 are ball bearings. For example, bearings 220 and 222 may be commercially available radial deep groove ball bearings, such as R144 miniature ball bearings.

In particular embodiments, stub 120 is coupled to the inner ring of bearings 220 and stub 122 is coupled to the inner ring of bearing 222. In the example of FIG. 2, stubs 120 and 122 have a "T" shape, shown sideways in the figure. The bottom of the "T" shape is disposed into and coupled to the center of the bearing (i.e., the inner ring), thus allowing the stub to rotate. The reference numerals 220 and 222 indicate the upper and lower portions of the cross-section rings, with an open space corresponding to the center of the ring where the lower stub portions of stubs 120 and 122 are disposed into. The outer rings of bearings 220 and 222 are coupled to their respective sides of barrel 110, thus allowing the stubs to spin with respect to a stationary pen, and conversely, allow the pen to spin with respect to stationary stubs. Thus, when a user pinches writing instrument 100 at stubs 120 and 122, the user is able to apply force to writing instrument 100 to spin it around its lateral axis while maintaining the pinching, as shown in FIG. 3. As an example, a user may pinch the writing instrument with the user's thumb on one stub and the middle finger on the other stub, and may flick the pen with the pinkie finger to make it spin.

In particular embodiments, writing instrument 100 may be a pen, as shown in the examples of FIGS. 1 and 2. Writing instrument may include an ink cartridge 230 disposed inside barrel 110 between bearings 220 and 222. Ink cartridge 230 may have an ink tip 232 facing the front of the writing instrument 100, the ink tip operable to dispense ink for writing on paper or other appropriate surfaces. In this manner, the tip 232 may be operable to extend out of and retract into the inside of barrel 110 through an opening 212 at the front of barrel 100.

In particular embodiments, writing instrument 100 may include a mechanism for moving ink cartridge 230 so as to extend the ink tip 232 of the ink cartridge outside of barrel 110 through opening 212. FIG. 2 shows an example tubular member 240 disposed inside the barrel operable to receive ink cartridge 230. Tubular member 240 may be operable to receive force from the back of writing instrument 100 and thus move to push ink cartridge 230 through opening 212. In particular embodiments, tubular member 240 may be coupled to a button 242 that a user pushes to provide force and thus extend the ink tip 232 for writing.

In particular embodiments, tubular member 240 may be held in an extended position by a locking mechanism. FIG. 1 and show an example locking mechanism comprising a knob 150 and a u-shaped notch 152. The locking mechanism may be unlocked my moving knob 150 towards the bottom of the "U" of notch 152, thus allowing the knob to slide from one end to the other to either extend or retract tubular member 240. Moving the knob towards one of the top ends of the "U" of notch 152 locks the knob in a stable position, and thus maintains the ink cartridge in either an extended or retracted position. In particular embodiments, ink cartridge 230 may be surrounded by a spring 244 that provides upward force to tubular member 240, thus aiding the user in retracting the ink cartridge upon unlocking the locking mechanism.

While a particular mechanism for extending and retracting an ink cartridge of writing instrument 100 has been described, this disclosure contemplates any suitable locking mechanism for extending and retracting an ink cartridge. For example, standard pen clicker mechanisms using cam locks can be applied in a similar manner.

In particular embodiments, writing pen 100 may include a single bearing instead of two bearings as described above. As an example, two stubs 120 and 122 may be coupled to the inner ring of a single ball bearing. In particular embodiments, a writing instrument with a single bearing would further include an ink reservoir such as, for example, an ink reservoir for usage in a fountain pen. For example, the ink reservoir may comprise a hollowed portion to make space for the single bearing and stubs. In this manner, a single bearing can make contact with both stubs.

It is to be appreciated that the Detailed Description section, and not the Summary and Abstract sections (if any), is intended to be used to interpret the claims. The Summary and Abstract sections (if any) may set forth one or more but not all exemplary embodiments of the invention as contemplated by the inventor(s), and thus, are not intended to limit the invention or the appended claims in any way.

References herein to "one embodiment," "an embodiment," "an example embodiment," or similar phrases, indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it would be within the knowledge of persons skilled in the relevant art(s) to incorporate such feature, structure, or characteristic into other embodiments whether or not explicitly mentioned or described herein.

The breadth and scope of the invention should not be limited by any of the above-described exemplary embodiments, but should be defined only in accordance with the following claims and their equivalents.

What is claimed is:

1. A writing instrument comprising:

a barrel;

a first bearing coupled to an interior side of the barrel;

a second bearing coupled to an interior opposite side of the barrel;

a first stub protruding from a side of the barrel, the stub being in contact with the bearing so as to allow the stub to spin around a lateral axis of the barrel, the lateral axis comprising an axis perpendicular to a length of the barrel; and a second stub protruding from an opposite side of the barrel, the second stub being in contact with the second bearing so as to allow the second stub to spin around the lateral axis of the barrel.

2. The writing instrument of claim 1, further comprising:

an ink cartridge disposed lengthwise inside the barrel between the first and second bearings; and a mechanism for extending a tip of the ink cartridge outwards towards a front of the barrel.

3. The writing instrument of claim 2, wherein the mechanism for extending the tip of the ink cartridge further comprises:

a tubular member disposed inside the barrel, the tubular member operable to receive a back end of the ink cartridge and push the ink cartridge towards the front of the barrel.

4. The writing instrument of claim 3, wherein the tubular member and barrel include a locking mechanism for holding the tubular member in an extended position or a retracted position.

5. The writing instrument of claim 4, wherein the ink cartridge is surrounded by a compression spring in contact with the tubular member.

6. The writing instrument of claim 1, wherein the writing instrument is a pen.

7. The writing instrument of claim 1, wherein the writing instrument is a mechanical pencil.

8. The writing instrument of claim 1, wherein the writing instrument is a stylus.

9. The writing instrument of claim 1, wherein an outer portion of the stub has a cylindrical shape.

10. The writing instrument of claim 1, wherein an outer portion of the stub has a rounded shape.

11. The writing instrument of claim 1, wherein an outer portion of the stub is carved with an image.

12. The writing instrument of claim 11, wherein the writing instrument is a mechanical pencil.

13. The writing instrument of claim 11, wherein the writing instrument is a stylus.

14. The writing instrument of claim 11, wherein an outer portion of the stub has a cylindrical shape.

15. The writing instrument of claim 11, wherein an outer portion of the stub has a rounded shape.

16. The writing instrument of claim 11, wherein an outer portion of the stub is carved with an image.

17. A writing instrument comprising:

a barrel;

a bearing coupled to an interior of the barrel;

a first stub protruding from a side of the barrel, the stub being in contact with the bearing so as to allow the stub to spin around a lateral axis of the barrel, the lateral axis comprising an axis perpendicular to a length of the barrel; and a second stub protruding from an opposite side of the barrel, the second stub being in contact with the bearing so as to allow the second stub to spin around the lateral axis of the barrel.

18. The writing instrument of claim 17, further comprising:

an ink reservoir disposed lengthwise inside the barrel, the reservoir shaped to include a hollowed space for the bearing so that the bearing can make contact with both the first and second stubs.

19. The writing instrument of claim 18, wherein the writing instrument is a pen.

20. The writing instrument of claim 19, wherein the writing instrument is a fountain pen.

* * * * *